US006668810B1

(12) United States Patent
St. John et al.

(10) Patent No.: US 6,668,810 B1
(45) Date of Patent: Dec. 30, 2003

(54) IGNITION COIL ASSEMBLY WITH SPARK PLUG CONNECTOR

(75) Inventors: Richard William St. John, Ann Arbor, MI (US); William Douglas Walker, Saline, MI (US); Todd C. Sexton, Howell, MI (US); Rick S. Burchett, Ypsilanti, MI (US); Alex William Widiger, Canton, MI (US); Francis Martin Donahue, III, Ypsilanti, MI (US)

(73) Assignee: Visteon Global Technologies, Inc., Dearbor, MI (US)

( * ) Notice: Subject to any disclaimer, the term of this patent is extended or adjusted under 35 U.S.C. 154(b) by 0 days.

(21) Appl. No.: 10/288,777

(22) Filed: Nov. 6, 2002

(51) Int. Cl.[7] ..... F02P 13/00

(52) U.S. Cl. ..... 123/634; 123/635; 336/107; 439/127

(58) Field of Search ..... 123/634, 635; 439/127; 336/107

(56) References Cited

U.S. PATENT DOCUMENTS 1,933,304 A 10/1933 Bell
5,340,323 A 8/1994 Imanishi et al.
5,357,233 A 10/1994 Wada
5,421,736 A 6/1995 Imanishi et al.
5,827,079 A 10/1998 Murata
6,252,482 B1 6/2001 Chiba et al.
6,340,303 B2 1/2002 Hamada et al.
6,443,137 B1 9/2002 Kraft et al.
2003/0070664 A1 * 4/2003 Skinner et al. ..... 123/634

* cited by examiner

*Primary Examiner*—Erick Solis
(74) *Attorney, Agent, or Firm*—Brinks Hofer Gilson & Lione

(57) ABSTRACT

An ignition coil assembly of the type which is directly mounted onto an associated internal combustion engine spark plug. The coil assembly includes a spark plug boot section made of a highly elastic material with an inside cylindrical passageway. The inside passageway features ribs which engage a high voltage connection coil spring positioned in the passageway to make an electrical connection between the coil and spark plug high voltage terminals. The spring has a generally constant outside diameter outer section except its end segments have a reduced diameter where they contact the high voltage terminals. The passageway ribs retain the spring in position prior to its installation and after its removal from the associated spark plug.

19 Claims, 3 Drawing Sheets

IGNITION COIL ASSEMBLY WITH SPARK PLUG CONNECTOR

FIELD OF THE INVENTION

This invention relates to an ignition coil assembly for an internal combustion engine and, in particular, to such a device mounted directly onto its associated spark plug.

BACKGROUND OF THE INVENTION

In order to provide enhanced ignition performance, modern internal combustion engines used in automotive applications employ an ignition coil mounted directly on each of the spark plugs. Various styles of directly mounted ignition coils are used in which an ignition coil is mounted to a spark plug or adjacent to an associated spark plug without the need for a long flexible high voltage lead. Variations include so-called "pencil", "stick", "cigar", "plug hole" or. "coil-on-plug" type ignition coils. Modern ignition systems generate extremely high voltages necessary to precisely and reliably initiate the combustion process within the combustion chamber. Directly mounted ignition coils provide numerous advantages over other types including: elimination of high voltage leads, elimination of "waste spark" mode, and packaging benefits. Typically, a soft rubber boot is used to encase the spark plug, which is an extension of the coil-on-plug assembly.

The electrical connection between the high voltage terminal of the ignition coil and the spark plug terminal is very important. A reliable and secure connection must be made and it has been found that conventional coil spring type connectors can lead to ignition system failures when the cut end portions of the spring ends cause electromagnetic field concentrations. This can lead to dielectric failure of the ignition coil (i.e., arcing between the spring to a conductive surface outside the rubber boot). The ignition coil assembly is inserted substantially inside the spark plug insertion hole in the cylinder head of the internal combustion engine and, therefore, it is surrounded by an electrical ground. If a point of electro-magnetic field concentration is present at a location where the gap between it and a ground surface is small, dielectric failure can occur.

In addition to the design consideration mentioned previously, the ignition coil assembly must provide a reliable electrical connection, enable servicing, and minimize the number of separate components, and especially loose parts, which tend to lead to assembly related defects.

Other types of ignition coil connectors are also presently used. For example, metal springs or clips can be rigidly attached to the high voltage terminal on the coil-on-plug ignition coil assembly. In order to prevent the spring or clip from falling out of the ignition coil assembly spark plug boot, this design approach requires the spring or clip to be pushed onto and over the high voltage terminal. These configurations are not ideal for certain installation and packaging design approaches.

SUMMARY OF THE INVENTION

In accordance with this invention, a directly mounted type ignition coil assembly is provided having a spark plug boot section formed of a highly resilient material. A coil type high voltage connection spring is installed in the boot section and at opposite ends, electrically contacts the coil and spark plug high voltage terminals. Preferably, the end segments of the spring have a smaller bending radius than the spring center section to avoid problems associated with the electromagnetic field concentrations mentioned previously since the cut ends are positioned to create a large gap to a ground surface. The internal passageway of the coil boot features a generally uniform cylindrical diameter. However, a number of ribs are provided which engage the center section of the spring so that the spring can be retained in the boot before the ignition coil is installed on the spark plug. The ribs are formed in a manner that does not interfere with the molding of the boot section.

The high voltage connection spring is inserted into the orifice of the spark plug boot section and is pressed into position such that it engages the boot passageway ribs. When the coil assembly is installed on the spark plug, the spring is compressed and pushed past the area where the ribs are present. During servicing, when the ignition coil assembly is removed, the spring is allowed to expand, but again engages with the ribs, preventing the spring from falling out of the ignition coil assembly.

The ignition coil assembly in accordance with this invention provides the advantages of a connector which is rigidly connected in that the parts are retained, yet avoids the shortcomings of such designs which can lead to failures mentioned previously.

Additional benefits and advantages of the present invention will become apparent to those skilled in the art to which the present invention relates from the subsequent description of the preferred embodiment and the appended claims, taken in conjunction with the accompanying drawings.

DETAILED DESCRIPTION OF THE INVENTION

Figure 1:
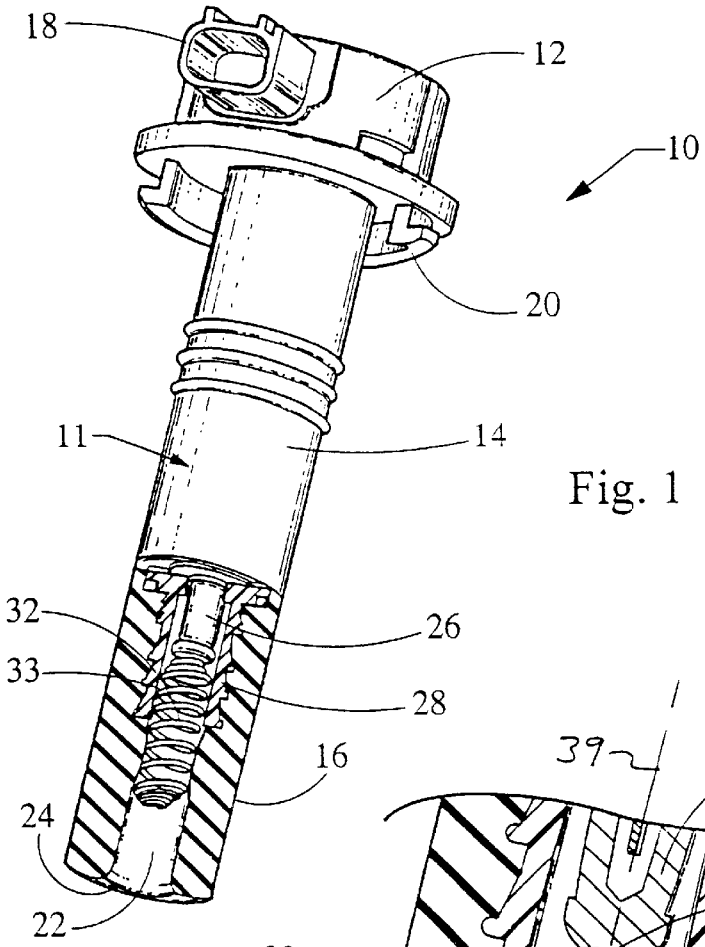
FIG. 1 is a pictorial view of an ignition coil assembly in accordance with this invention with the spark plug boot section shown in cross-section.

An ignition coil assembly in accordance with this invention is shown in a completely assembled condition in FIG. 1 and is generally designated there by reference number 10. Ignition coil assembly 10 includes body 11 having an enlarged diameter head 12, a generally uniform diameter barrel section 14, and a lower spark plug boot section 16.

Coil assembly head 12 includes electrical connector 18 which provides a receptacle for installation for a snap-fitting type mating electrical connector which provides the electrical signal for the coil assembly 10 to initiate an ignition spark. Head 12 further forms retention flange 20 which mates with a correspondingly shaped part in the engine cylinder head for retaining the coil assembly 10 in its installed position. Barrel section 14 encloses internal components, such as the conductor coil windings of the coil assembly 10, and has a generally uniform diameter, enabling the coil assembly 10 to be inserted into the associated passageway in the cylinder head (not shown). Spark plug boot section 16 features a hollow inside passageway 22 having a generally constant diameter smooth inside cylindrical surface which opens at the bottom of the coil assembly at orifice 24. Boot section 16 is preferably formed of a highly elastic material, such as silicone rubber.

Figure 2:
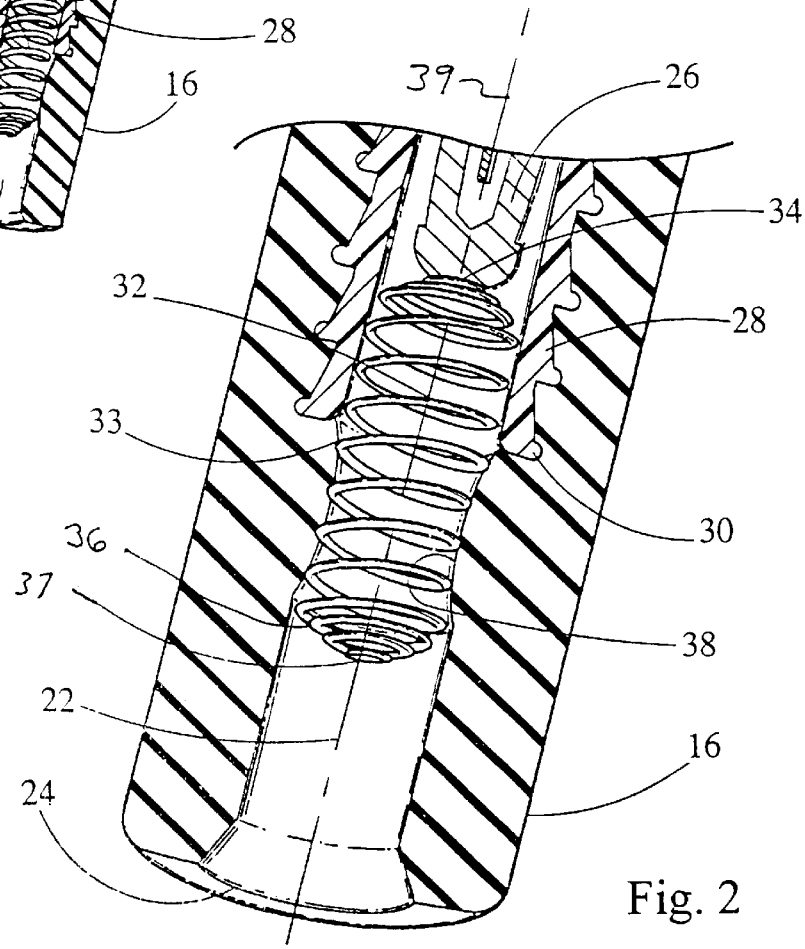
FIG. 2 is an enlarged cross-sectional view taken from FIG. 1.

Now with reference to the sectioned portions of FIG. 1 and FIG. 2, internal features and elements of boot section 16 are shown in more detail. A high voltage coil terminal 26 protrudes from barrel section 14 into boot passageway 22 and is surrounded by a rigid hollow tube 28. Tube 28 has exterior ribs 30 which are provided to enhance the insulation properties of the tube.

High voltage connection spring 32 is a coil type spring and is shown installed within passageway 22. Spring 32 has a center section 33 having a number of turns of wire having a generally constant bending radius. The outside diameter of the center section 33 is slightly less than the inside diameter of passageway 22. First and second spring end segments 34 and 36, however, have a reduced radius as compared with center section 33. In other words, end segments 34 and 36 are "turned down" to have a continuously decreasing radius. Cut ends 35 (not shown) and 37 of end segments 34 and 36 respectively are the terminal ends of the wire forming spring 32. Preferably, cut ends 35 and 37 have the smallest radius of curvature of the turns forming spring 32. Cut ends 35 and 37 are positioned near the longitudinal centerline 39 of spring 32 (and passageway 22) as shown in FIG. 2.

Figure 5:
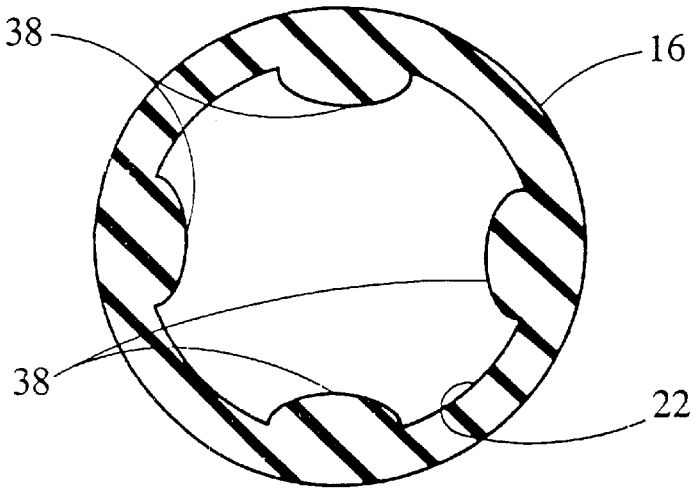
FIG. 5 is a cross-sectional view taken along line 5—5 from FIG. 4.

Boot passageway 22 features a number of radially inwardly protruding ribs 38. In the embodiment illustrated by the figures, four ribs 38 are provided, as best shown in FIG. 5. Ribs 38 have a generally semi-circular configuration, smoothly blending with the inside wall surface of boot passageway 22 at their edges 40 and 42 (i.e., where they merge along the longitudinal direction). Ribs 38 are elongated in the longitudinal direction along passageway 22. Ribs 38 and inside passageway 22 are configured so that boot section 16 can be formed by molding of the elastic material over a post and, following curing of the material of boot section 16, allowing the boot section to be pulled off of the forming post, without damaging the inside passageway 22.

Other configurations for ribs 38 may be provided in accordance with this invention. For example, a greater or fewer number of ribs 38 could be provided. It would be necessary, however in the case of a one-piece molded part, to ensure that the part may be pulled off of the forming post or tool.

Figure 3:
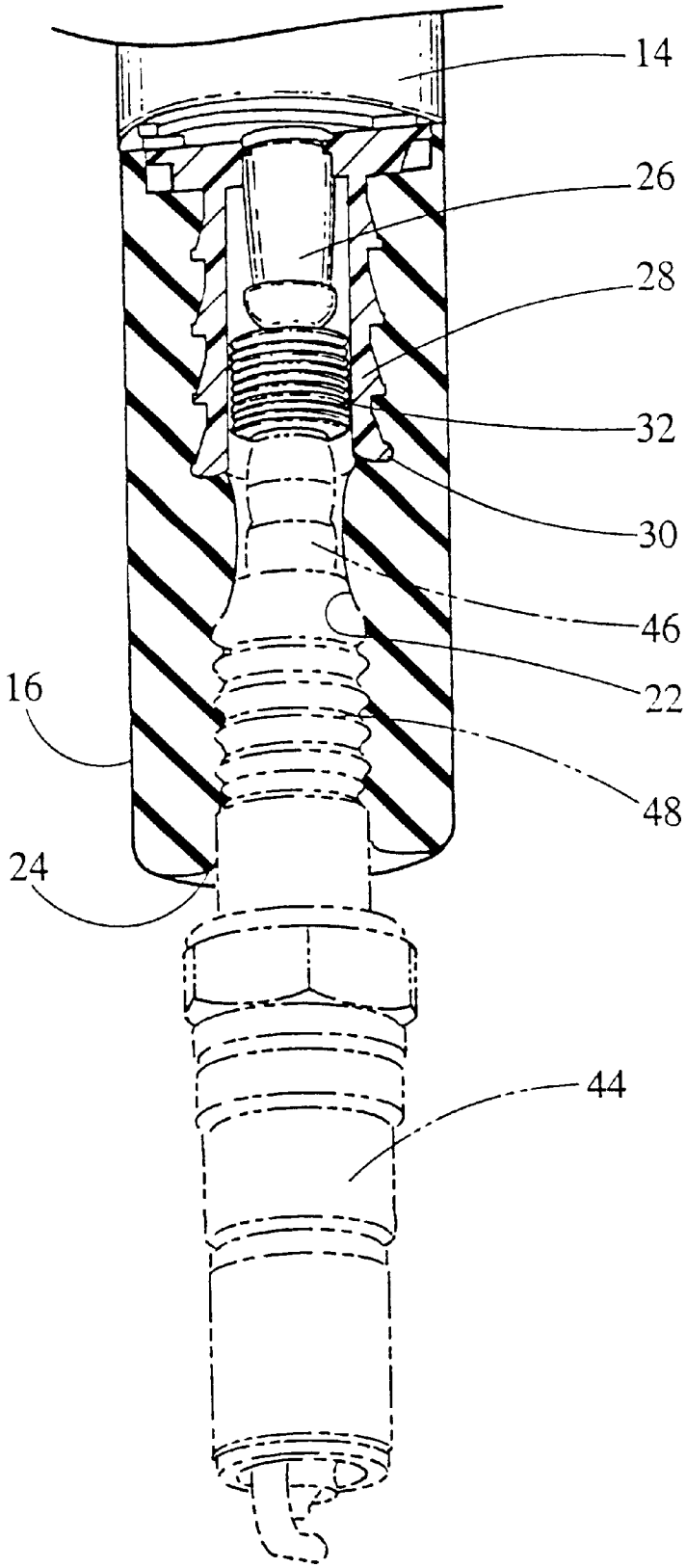
FIG. 3 illustrates the ignition coil assembly installed onto the spark plug.

After ignition coil assembly 10 is fully fabricated and assembled, spring .32 is installed by pushing it through orifice 24 and into passageway 22 until it engages with ribs 38 which acts as a retainer means for retaining the spring in the passageway. The outside constant diameter of spring center section 33 in its relaxed state is slightly less than the inside diameter of passageway. 22, except in the area of ribs 38. Ribs 38 protrude radially inwardly and frictionally retain spring 32 in position, as shown in FIGS. 1 and 2. In this condition, coil assembly 10 may be handled and transported without causing spring 32 to fall from its installed position from within passageway 22. FIG. 3 shows the coil assembly 10 installed onto a representative spark plug 44. As shown, spark plug 44 includes high voltage terminal 46 and ceramic insulator 48. As coil assembly 10 is installed over spark plug 44, high voltage terminal 46 engages spring end segment 36 and compresses the spring, forcing it to move upwardly through passageway 22, past the location of ribs 38. As shown in FIG. 3, spring 32 becomes compressed between high voltage terminals 26 and 46. In this condition, spring end segments 34 and 36 are maintained in contact with the terminals 26 and 46 solely due to the compression of spring 32 between the terminals. In the installed condition, ribs 38 no longer function to interact with spring 32. Inside passageway 22 of the boot section conforms closely to spark plug insulator 48 to provide a sealed connection with spark plug 44. The compression of spring 32 allows the installed position of coil assembly 10 to vary with respect to spark plug terminal 26 while providing a good electrical connection.

Figure 4:
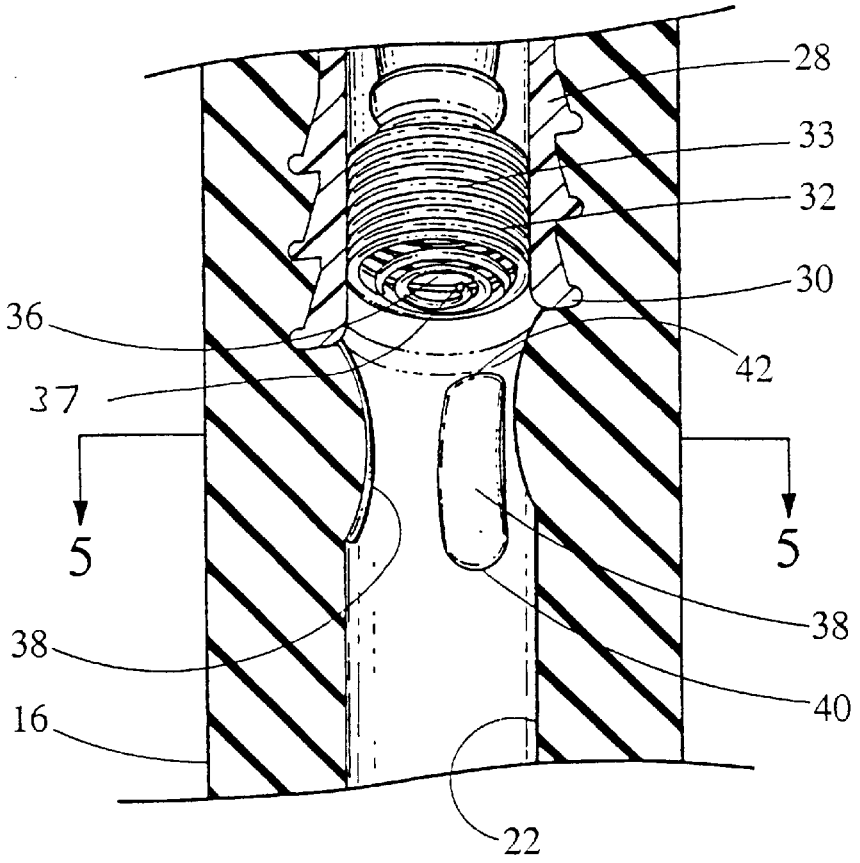
FIG. 4 is a partial cross-sectional view of the spring in a compressed state, but with the spark plug removed, for illustrating the configuration of the boot section passageway.

FIG. 4 shows the compressed condition of spring 32 when the spark plug 44 is in position. However, FIG. 4 deletes the spark plug for purposes of better illustrating the configuration of internal features, such as ribs 38. FIG. 4 also illustrates that the spring end of segment 36 is turned to a continuously decreasing radius, terminating at cut end 37. As mentioned previously, this configuration avoids failure due to electromagnetic field concentrations which tend to collect at points. Since the position of spring cut ends 35 and 37 is positioned near the longitudinal centerline of coil assembly 10, the greatest distance exists between these points of field concentration and any electrical ground, such as that provided by the cast metal material of the associated cylinder head. In addition, cut ends 35 and 37 are firmly pressed against terminals 26 and 46 by compression of springs 32, increasing the conduction at those points.

Preferably, spring end segments 34 and 36 are of identical configurations, enabling spring 32 to be installed with either of their cut ends 35 and 37 contacting coil terminal 26.

When it is desired to service the associated internal combustion engine, coil assembly 10 may be removed from its connection with spark plug 44. When this occurs, spring 32 expands back to the position shown in FIGS. 1 and 2. In this condition, ribs 38 again retain spring 32 in position and prevent it from becoming loose from the assembly.

While the above description constitutes the preferred embodiment of the present invention, it will be appreciated that the invention is susceptible to modification, variation, and change without departing from the proper scope and fair meaning of the accompanying claims.

We claim:

1. An ignition coil assembly for direct mounting onto a spark plug and for providing an electrical connection with a spark plug terminal of the spark plug, the ignition coil assembly comprising:

a body having a spark plug boot section, the boot section having an interior longitudinally extending passageway opening at an orifice, the body having a coil terminal extending into the boot section passageway;

a high voltage connection coil spring placed within the boot section passageway through the orifice, the spring having a center section having multiple turns of wire and having two opposing end segments wrapped at a smaller radius than the center section, the spring end segments contacting the spark plug terminal and the coil terminal when the ignition coil assembly is installed on the spark plug with the spark plug extending inside the passageway and compressing the spring; and retainer means for retaining the spring within the boot passageway when the ignition coil assembly is not installed on the spark plug, wherein said retainer means includes at least one rib extending radially inwardly within the passageway and frictionally engaging the spring when the spring is in the passageway.

2. The ignition coil assembly according to claim 1 wherein the spark plug boot section is formed of an elastic material.

3. The ignition coil assembly according to claim 1 wherein the spark plug boot section is formed of silicone rubber.

4. The ignition coil assembly according to claim 1 wherein four ribs are provided which are elongated in the longitudinal direction.

5. The ignition coil assembly according to claim 1 wherein the coil spring end maintain contact with the ignition coil terminal and the spark plug terminal solely due to the compression of the spring between the terminals.

6. The ignition coil assembly according to claim 1 wherein the end segments terminate in cut ends and the turns of wire of the end segments are formed at a continuously decreasing radius of curvature from the center section to the cut ends.

7. The ignition coil assembly according to claim 1 wherein both the opposing end segments are of identical configuration.

8. The ignition coil assembly according to claim 1 wherein the end segments terminate at cut ends and the cut ends are positioned adjacent the longitudinal centerline of the spring.

9. The ignition coil assembly according to claim 1 wherein the spring center section is formed of multiple turns of wire wrapped at a generally constant bending radius such that the spring center section has an outside diameter slightly smaller than the inside diameter of the passageway.

10. An ignition coil assembly for direct mounting onto a spark plug and for providing an electrical connection with a spark plug terminal of the spark plug, the ignition coil assembly comprising:

a body having a spark plug boot section, the boot section formed of an elastic material and having a cylindrical interior longitudinally extending passageway of a generally constant diameter opening at an orifice, the body having a coil terminal extending into the boot section passageway;

a high voltage connection coil spring placed within the boot section passageway through the orifice, the spring having a center section having multiple turns of wire wrapped at a generally constant bending radius such that the spring has an outside diameter less than the inside diameter of the passageway, the spring further having two opposing end segments wrapped at a smaller diameter than the center section, the spring end segments contacting the spark plug terminal and the coil terminal when the ignition coil assembly is installed on the spark plug with the spark plug extending inside the passageway and compressing the spring; and at least one rib formed by the passageway for engaging the spring center section and retaining the spring within the boot passageway when the ignition coil assembly is not installed on the spark plug but is positioned longitudinally in the passageway such that the rib disengages the spring when the ignition coil assembly is mounted onto the spark plug thereby compressing the spring and pushing the spring away from its engagement with the rib.

11. The ignition coil assembly according to claim 10 wherein four ribs are provided which are elongated in the longitudinal direction of the passageway.

12. The ignition coil assembly according to claim 10 wherein the spark plug boot section is formed of silicone rubber.

13. The ignition coil assembly according to claim 10 wherein the coil spring end maintain contact with the ignition coil terminal and the spark plug terminal solely due to the compression of the spring between the terminals.

14. The ignition coil assembly according to claim 10 wherein the end segments terminate in cut ends and the turns of wire of the end segments are formed at a continuously decreasing radius of curvature from the center section to the cut ends.

15. The ignition coil assembly according to claim 10 wherein both the opposing end segments are of identical configuration.

16. The ignition coil assembly according to claim 10 wherein the end segments terminate at cut ends and the cut ends are positioned adjacent the longitudinal centerline of the spring.

17. An ignition coil assembly for direct mounting onto a spark plug and for providing an electrical connection with a spark plug terminal of the spark plug, the ignition coil assembly comprising:

a body having a spark plug boot section, the boot section having an interior longitudinally extending passageway opening at an orifice, the body having a coil terminal extending into the boot section passageway;

a high voltage connection coil spring placed within the boot section passageway through the orifice, the spring having a center section having multiple turns of wire and having two opposing end segments wrapped at a smaller radius than the center section, the spring end segments contacting the spark plug terminal and the coil terminal when the ignition coil assembly is installed on the spark plug with the spark plug extending inside the passageway and compressing the spring; and at least one rib extending radially inwardly within the passageway for frictionally engaging the spring center section when the spring is installed in the passageway but is positioned longitudinally in the passageway such that the rib disengages the spring when the ignition coil assembly is mounted onto the spark plug thereby compressing the spring and pushing the spring away from its engagement with the rib.

18. The ignition coil assembly according to claim 17 wherein four ribs are provided which are elongated in the longitudinal direction.

19. An ignition coil assembly for direct mounting onto a spark plug and for providing an electrical connection with a spark plug terminal of the spark plug, the ignition coil assembly comprising:

a body having a spark plug boot section, the boot section having an interior longitudinally extending passageway opening at an orifice, the body having a coil terminal extending into the boot section passageway;

a high voltage connection coil spring placed within the boot section passageway through the orifice, the spring having a center section having multiple turns of wire and having two opposing end segments wrapped at a smaller radius than the center section, the end segments terminate in cut ends and the turns of wire of the end segments are formed at a continuously decreasing radius of curvature from the center section to the cut ends, the spring end segments contacting the spark plug terminal and the coil terminal when the ignition coil assembly is installed on the spark plug with the spark plug extending inside the passageway and compressing the spring;

retainer means for retaining the spring within the boot passageway when the ignition coil assembly is not installed on the spark plug.

* * * * *